US005162811A

United States Patent [19]

Lammers et al.

[11] Patent Number: 5,162,811

[45] Date of Patent: Nov. 10, 1992

[54] PARABOLOIDAL REFLECTOR ALIGNMENT SYSTEM USING LASER FRINGE PATTERN

[76] Inventors: Uve H. W. Lammers, 5 San Mateo Dr., Chelmsford, Mass. 01824; Richard A. Marr, 24 Brentham Rd., N. Billerica, Mass. 01862

[21] Appl. No.: 649,780

[22] Filed: Jan. 31, 1991

[51] Int. Cl.[5] ..... H01Q 15/20

[52] U.S. Cl. ..... 343/915; 343/916; 343/912; 343/703

[58] Field of Search ..... 343/915, 912, 916, 782, 343/783, 703

[56] References Cited

U.S. PATENT DOCUMENTS

| | | | |
|---|---|---|---|
| 4,458,251 | 7/1984 | Bondon | 343/914 |
| 4,482,897 | 11/1984 | Dragone et al. | 343/779 |
| 4,529,277 | 7/1985 | Gee et al. | 343/915 |
| 4,660,941 | 4/1987 | Hattori et al. | 350/487 |
| 4,710,777 | 12/1987 | Halverson | 343/840 |
| 4,780,726 | 10/1988 | Archer et al. | 343/915 |
| 4,811,033 | 3/1989 | Ahl et al. | 343/880 |
| 4,811,034 | 3/1989 | Kaminskas | 343/915 |
| 4,825,223 | 4/1989 | Moore | 343/840 |
| 4,862,190 | 8/1989 | Palmer et al. | 343/915 |
| 4,893,132 | 1/1990 | Habibi | 343/915 |

OTHER PUBLICATIONS

Nelson, Jerry, "The Keck Telescope", published in American Scientist, 1989, vol. 77, pp. 170–176.

*Primary Examiner*—Michael C. Wimer
*Assistant Examiner*—Hoanganh Le

[57] ABSTRACT

A paraboloidal antenna system is disclosed which is segmented. Each segment is attached to a back up structure at three points, and is capable of linear normal motion at these points. The segments can be individually adjusted so as to conform to the true paraboloidal surface after the backup structure has been deformed. The adjustable attach points include digitally-controlled actuators. A laser reference system is used to detect deviations from the true paraboloidal contour. The laser beam is split to set up two sources along the paraboloid axis, and the ensuing hyperboloidal fringe pattern is of circular symmetry. Sensors determine the number of fringes lost or gained as the backup structure deforms. This data is used to guide the actuators to correct for the deviations.

5 Claims, 7 Drawing Sheets

PARABOLOIDAL REFLECTOR ALIGNMENT SYSTEM USING LASER FRINGE PATTERN

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to paraboloidal antenna systems, and more specifically the invention pertains to a means for maintaining a paraboloidal surface contour which is required for optimum performance of large aperture-to-wavelength ratio antennas.

Communication antennas often make use of an antenna dish, which provides a wide surface for capturing radio frequency signals. Such antennas usually have a paraboloidal shape. The advantage of the paraboloidal contour is that signals arriving parallel with its axis of symmetry are reflected to the focal point of the paraboloid, where a primary feed or pickup probe is located.

The maximum diameter-to-wavelength ratio, at which large microwave and millimeter wave reflectors produce acceptable gain and radiation patterns, depends on the precision of the paraboloidal contour as manufactured and retained under environmental stress. For terrestrial applications, massive mechanical backup structures are generally required to support paraboloidal surfaces of 1000 wavelengths or more in diameter against deformation due to gravity, wind loading, and other forces. For spaceborne applications, thermal stresses and lack of rigidity of unfurlable designs set a lower limit to the wavelength at which they can be used.

High gain, space-borne satellite communication antennas must accurately maintain their gains to provide the required link margins. Lightweight spacebased antennas are particularly vulnerable to erection induced deformations. The impact of these errors becomes increasingly more severe as the operating frequency increases. Thus, correction techniques such as this invention will become more and more important in future systems. Large groundbased antennas operating at frequencies up to and exceeding 1OO GHz will also need such alignment systems to maintain performance.

Certain aspects of the task of reducing the need for structural rigidity of large paraboloidal antenna reflector systems by providing a means for dynamically correcting errors in the paraboloidal contour are included, to some extent, by the systems disclosed in the following U.S. Patents, the disclosures of which are incorporated herein by reference:

U.S. Pat. No. 4,825,223 issued to Moore;
U.S. Pat. No. 4,710,777 issued to Halverson;
U.S. Pat. No. 4,482,897 issued to Dragone et al;
U.S. Pat. No. 4,458,251 issued to Bandon;
U.S. Pat. No. 4,811,033 issued to Ahl et al;
U.S. Pat. No. 4,660,941 issued to Hattori et al.

The patents identified above relate to reflectors and antennas. In particular, the Moore patent describes a reflective assembly of paraboloidal surfaces, each individually but rigidly aligned, so that microwave signals impinging on any of the surfaces are reflected onto one common focal point.

Halverson discloses a dish antenna structure which uses reinforced inner ribs to strengthen the dish shape and limit its flexibiltity.

The Dragone et al patent describes an antenna with a segmented reflecting surface. The segmentation of the reflecting surface provides for separate images of the far field area of the antenna on separate focal surfaces. This is the reverse of what is intended by the subject invention. It proves, though, that individual panels can be aligned such that they focus onto desired points.

The Bandon patent relates to a paraboloidal microwave reflector, which can be assembled from a plurality of identical and interchangeable rigid fiberglass panels. To assure thermal stability the panels are supported by ribs. The ribs form a mounting ring and incorporate self-indexing devices for automatic alignment of the panel front surfaces.

The Ahl et al patent discloses a system for controlling the surface contour of a deployable and restorable antenna. The antenna, when deployed, forms a paraboloidal reflector surface. The Ahl et al disclosure attains its objective by spacially deforming the single continuous reflector surface through appropriately placed external forces, rather than by optimally aligning an otherwise ideal set of paraboloidal subsurfaces.

A method for angular alignment of such ideal paraboloidal subsurfaces is presented in the Hattori et al patent. Dual stacks of piezoelectric transducers provide orthogonal tilt to a flat optical mirror surface.

In a journal article by J. Nelson, entitled "The Keck Telescope," published in American Scientist, 1989, Vol. 77, pp. 170–176, an optical 10 m reflector is described, composed of 36 hexagonal precision segments. These segments are arranged in a mosaic and their positions actively controlled to create a single continuous optical surface. Active position control is accomplished by sets of two capacitive sensors on every intersegment edge. Readings of all intersegment relative positions are interpreted by computer and position adjustment commands are issued to three actuators attached to each segment. Three actuators suffice to adjust the position and inclination of each segment and hence achieve a continuous and optimally aligned optical surface.

While the above-cited references are instructive, the task remains to provide an antenna reflector system, which is composed of segments, which can be individually adjusted to conform to a true paraboloidal surface, by referring to an absolute system of reference. The present invention is intended to satisfy that need.

SUMMARY OF THE INVENTION

The present invention is a paraboloidal antenna system, which has an adjustable reflective surface contour. The object is to adjust the surface contour to a mathematically true paraboloidal shape, as it is required to focus a plane wavefront onto a single point. One embodiment of the invention includes: an antenna frame support structure, a plurality of triangular reflective segments, a plurality of actuators, and a laser reference system.

The antenna frame support structure is an approximately paraboloidal housing, upon which the plurality of triangular reflective segments are attached to form a perfect paraboloidal reflector. Each triangular reflective segment has a corner adjacent to the corners of another two or more reflective segments at a location called a control point. Individual actuators are fixed between the antenna frame and the common corners of the triangular reflective segments. The actuators expand and contract to move the corners of the segments, respectively away from or towards the frame as required.

In the present invention, the triangular segments are supported at their three corners, and are capable of linear, normal motion at these points. The clusters of segment corners attached to actuators can be individually adjusted so as to conform to a true paraboloidal surface after the support structure has been deformed. A laser reference system is used to detect deviations from the true paraboloidal contour. The output from a single monochromatic laser is divided to simulate two spaced, coherent sources along the paraboloid axis. The ensuing hyperboloidal interference pattern of laser radiation is of axial symmetry and coaxial with the paraboloid. In a simple embodiment, sensors located at the control points count the number of interference fringes lost or gained as the backup structure deforms. This data is used to guide the actuators to correct for the deviations. A problem With this arrangement is that only changes from a reference contour can be compensated for. When first powered up electrically, such a system does not know how to attain the desired contour. Some means must be provided to make the true paraboloid the reference contour.

A more sophisticated embodiment of the invention makes use of an absolute reference system instead of the relative reference system described so far. If one or both of the coherent laser sources above move a known amount towards or away from each other, the fringe count at a stationary sensor becomes an absolute measure of that sensor's position relative to its position on the true paraboloidal contour. The actuator connected with the sensor can then be directed to move the control point to its optimum position. Since the sensor is not strictly stationary at any time, the linear laser displacement must occur fast enough to consider the sensor essentially stationary during this time period. The laser displacement is repetitive at a rate commensurate with the rate of reflector deformation.

It is an object of the present invention to provide an antenna system with an adjustable reflective surface. It is another object of the present invention to provide a paraboloidal reflective antenna, whose surface contour can be corrected for deformations caused by heat, gravity, wind and other forces. These objects, together with other objects, features, and advantages of the invention, will become more readily apparent from the following detailed description, when taken in conjunction with the accompanying drawings, wherein like elements are given like reference numerals throughout.

DETAILED DESCRIPTION OF THE PREFERRED EMBODIMENTS

The present invention includes an antenna system, which contains a reflector surface composed of segments, which can be individually adjusted to conform to a true paraboloidal surface. One embodiment of the invention includes triangular segments, which can be adjusted by actuators and aligned to a true paraboloidal contour with the help of a laser system.

Figure 1:
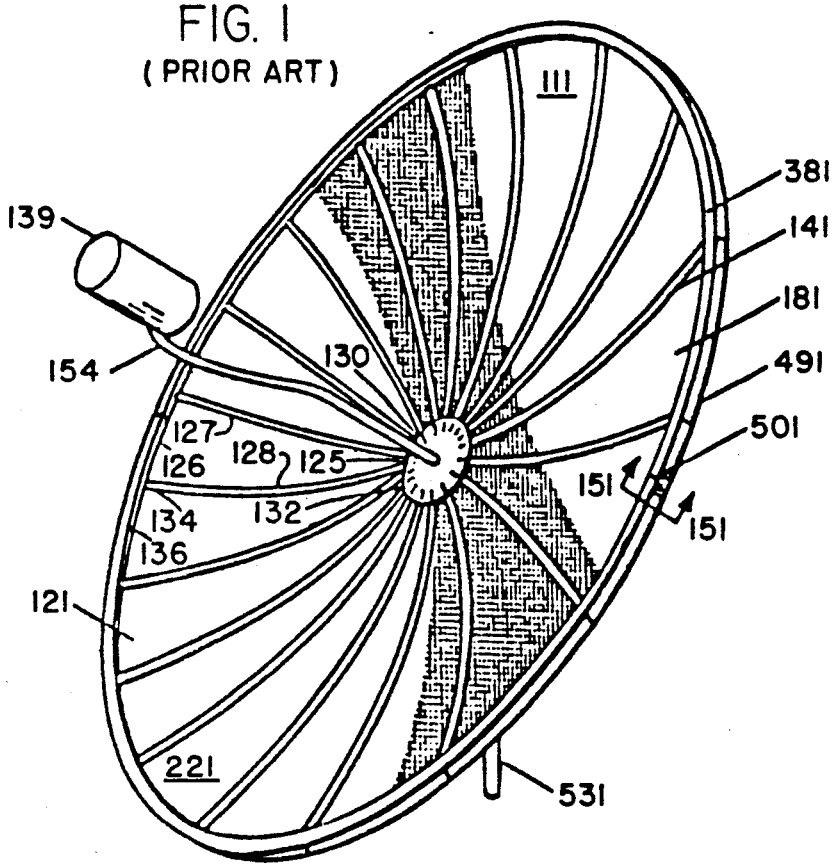
FIG. 1 (PRIOR ART)
FIG. 1 is an illustration of a prior art paraboloidal antenna system.

FIG. 1 is a generic example of a prior art communications antenna system as used in the above cited Halverson reference. The elements of the FIG. 1 antenna structure include a plurality of uniformly constructed ribs 141 of selected length and a plurality of sheet-like antenna panels 181 also uniformly constructed. The ribs 141 and the antenna panels 181 are alternately spaced in a generally radial manner to form a dish 121. Each antenna panel 181 is located with its inner edge 125 towards the support hub, its outer edge 126 away from the support hub, and its two opposed side edges 127 and 128 each oriented towards an adjacent rib 141. The antenna panels 181 are curved such that the anterior surface 111, defined by the front surfaces of the panels is generally concave. Preferably, each rib 141 is bent in a parabolic curve, the antenna panels 181 are shaped in sectors of a paraboloidal surface, and the dish anterior surface is thus generally parabolodial. This enables the antenna to most efficiently reflect and focus incoming radio frequency signals upon a point at which the pickup probe 139 may be located. Antenna panels 181 are essentially triangular. They could be made individually adjustable in position relative to each other and to the pickup probe 139, in order to correct for deformations occurring in the paraboloidal shape of the anterior surface 111.

Figure 2:
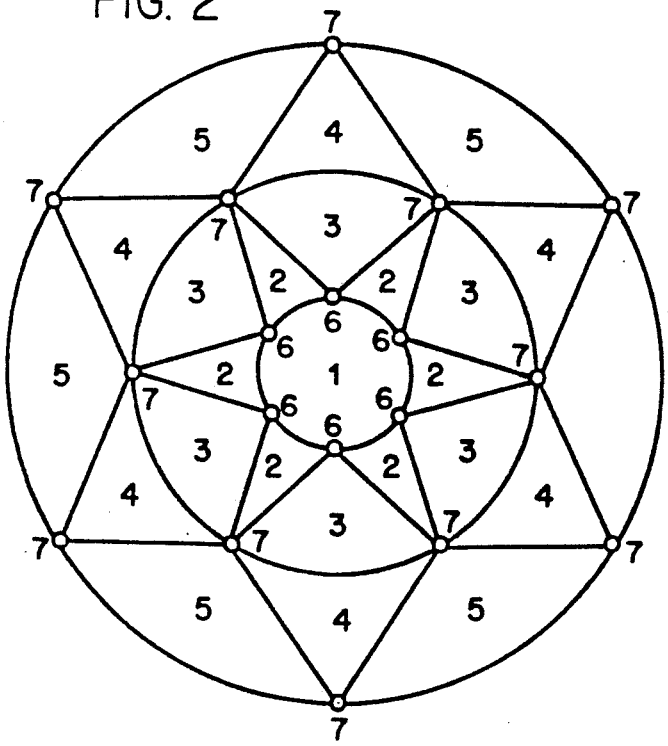
FIG. 2 is an illustration of a first kind of triangular segmentation of the adjustable reflector surface of the present invention.

FIG. 1 illustrates a basic form of triangular segmentation of a paraboloidal surface, which is amenable to precision alignment. FIG. 2 is a plan projection of one embodiment of an adjustable reflector surface of the present invention. The system of FIG. 2 is an adjustable paraboloidal reflector surface, which fits inside a backup structure to provide a reflective paraboloidal contour, which may be adjusted to correct for deformations. Instead of fixed panels 181 such as those in FIG. 1, the reflector surface in FIG. 2 is composed of a plurality of triangular segments 2 through 5, which are supported at each of their three corners by one of a number of pivot points 6 or actuators 7. These can individually move and tilt the panel as described below. The particular segmentation of the paraboloidal surface into triangles as shown in FIG. 2 is by way of example only. Other segmentations and their advantages will be shown later.

There exists a variety of alternative elements, which may serve as actuators, which move and tilt the reflector panels. For example, the system of FIG. 3 contains dual piezoelectric transducer (PZT) stacks 15*a* and 15*b*, which tilt an optical mirror in two orthogonal planes. If translation of the triangular, paraboloidal segments is required in addition to tilting, then three such PZTs are necessary.

Figure 3:
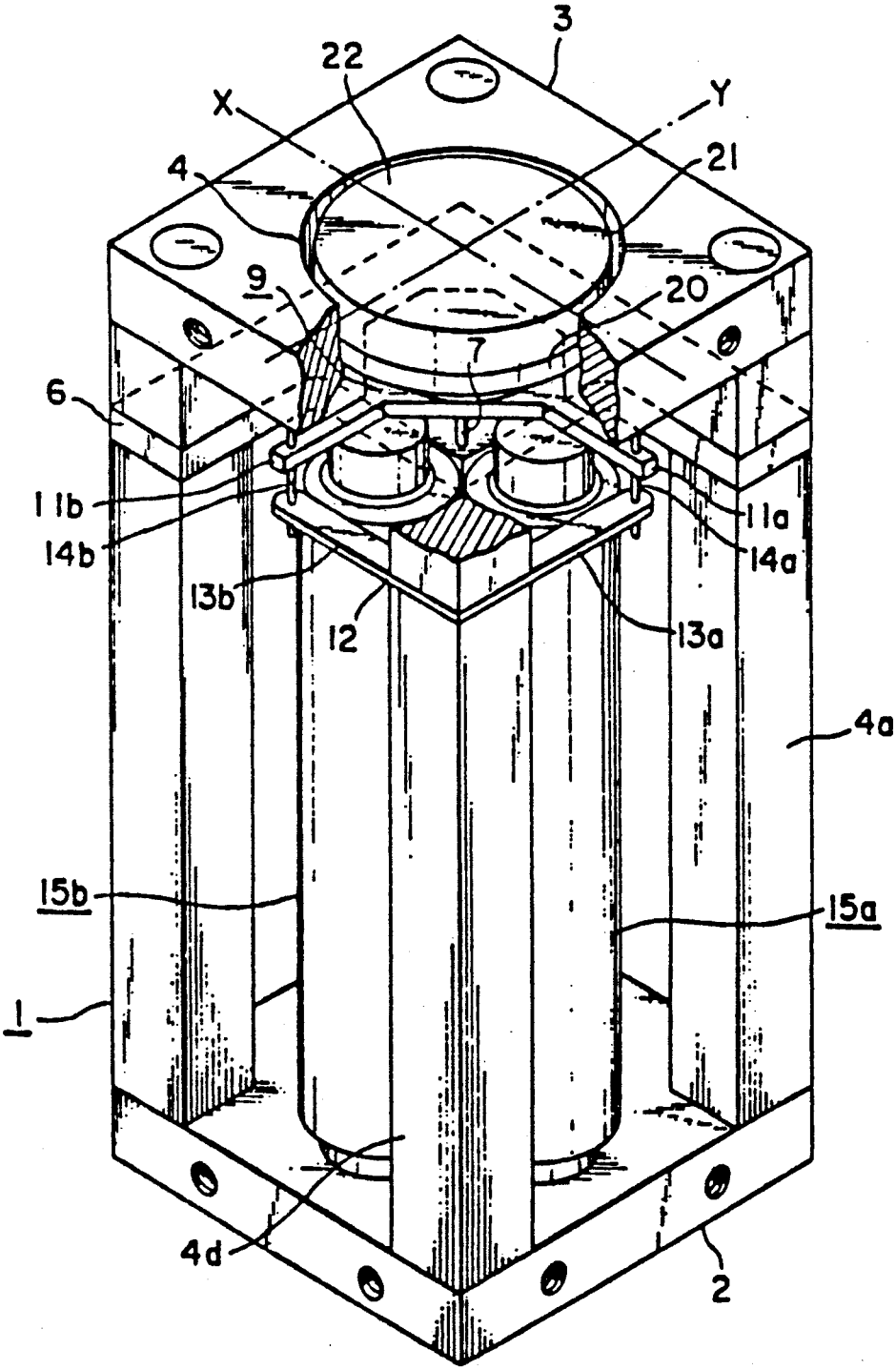
FIG. 3 is an illustration of a prior art piezoelectric transducer stack, which the present invention can use as an actuator.

The PZT elements in FIG. 3 expand when an electric voltage is applied as described in the above-cited Hattori et al reference. This characteristic allows the PZT element to act as a controllable piston, which can move the corner of a segment. Since piezoelectric transducers have a limited range of expansion, the system in FIG. 3 might be supplemented by a set of mechanical lead screws connected in tandem with the PZTs, where these serve as coarse positioning elements while the PZTs serve as fine positioning elements. The particular choice of actuators depends to a large extent on the radio wavelength as well, since the paraboloidal surface must be typically corrected to one tenth of a wavelength in order to avoid gain losses through deformation of the reflector. The Nelson article cited above achieves sufficient alignment precision at optical wavelengths in a completely different way by using levered mechanical screws.

Fundamentally, the paraboloidal reflector alignment problem is three dimensional. By virtue of the axial symmetry of the reflector contour and of the reference fringe pattern, the mathematical treatment of the alignment problem can be reduced to a two dimensional one. Also, we make the assumption that paraboloidal deformations occur, to a first degree, in directions normal to the paraboloidal surface.

Figure 4:
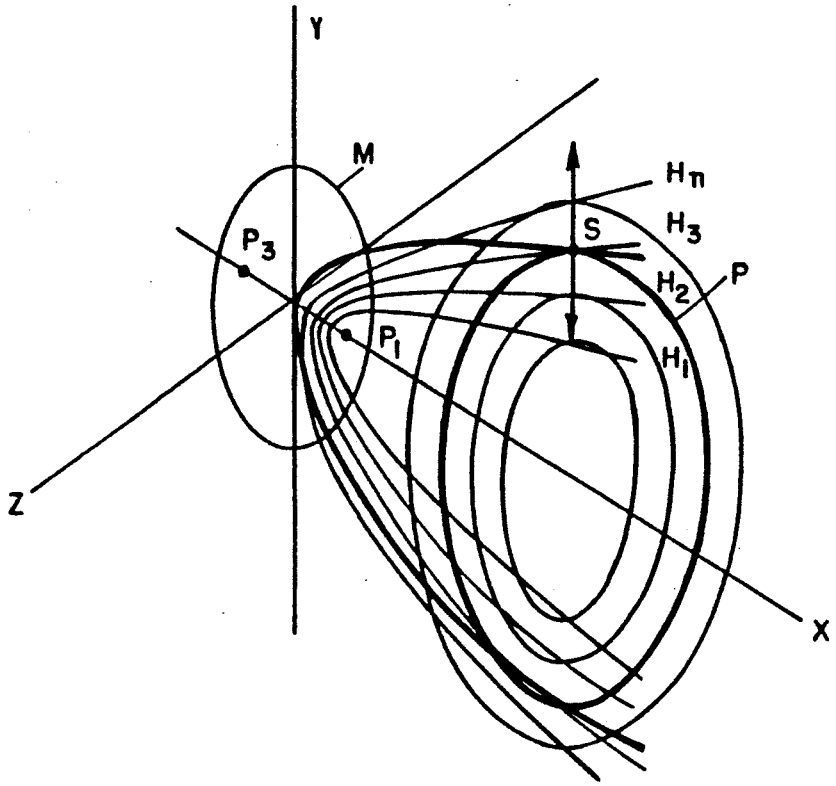
FIG. 4 is a schematic of a paraboloid and set of hyperboloidal fringes drawn with respect to a three dimensional Cartesian coordinate system.

The reader's attention is now directed towards FIG. 4, which shows a three dimensional Cartesian coordinate system. Coherent laser signals of identical amplitude and phase transmitted omnidirectionally from points $P_1$, $(x_1,O)$ and $P_3(-x_1,O)$ along the x-axis will set up an interference or fringe pattern of hyperboloids of revolution, $H_1$ through $H_n$, coaxial with the x-axis. Reinforcement and cancellation of laser radiation can be detected by a sensor S moving orthogonally to the hyperboloidal surfaces.

Assume that $P_3$ is a virtual source of laser radiation. That is, a plane mirror M of sufficient size is mounted in the yz-plane centered at the origin of the coordinate system, which reflects the laser's radiation coming from $P_1$. This will set up only one branch of hyperboloids in the positive x-halfspace as drawn in FIG. 4. The laser is mounted inside a paraboloidal antenna reflector P, whose apex touches the yz-plane and whose axis of rotation is the x-axis. The paraboloid is shown in heavier lines in FIG. 4. A part of the reflector surface near the apex must either be removed so that laser radiation can be reflected from the mirror, or must be made penetrable to laser radiation while being impervious to radio signals. Thus, holes in the reflector of a diameter small enough to be beyond the radio cutoff wavelength would be able to pass through laser radiation. Alternatively, the mirror could be mounted forward of the apex to reduce blockage. This would lead to a different set of hyperboloids. As the paraboloid deforms under external forces, sensors mounted at strategic locations on the paraboloidal surface register the number of fringes penetrated and hence, the paraboloid's deformation.

Figure 5:
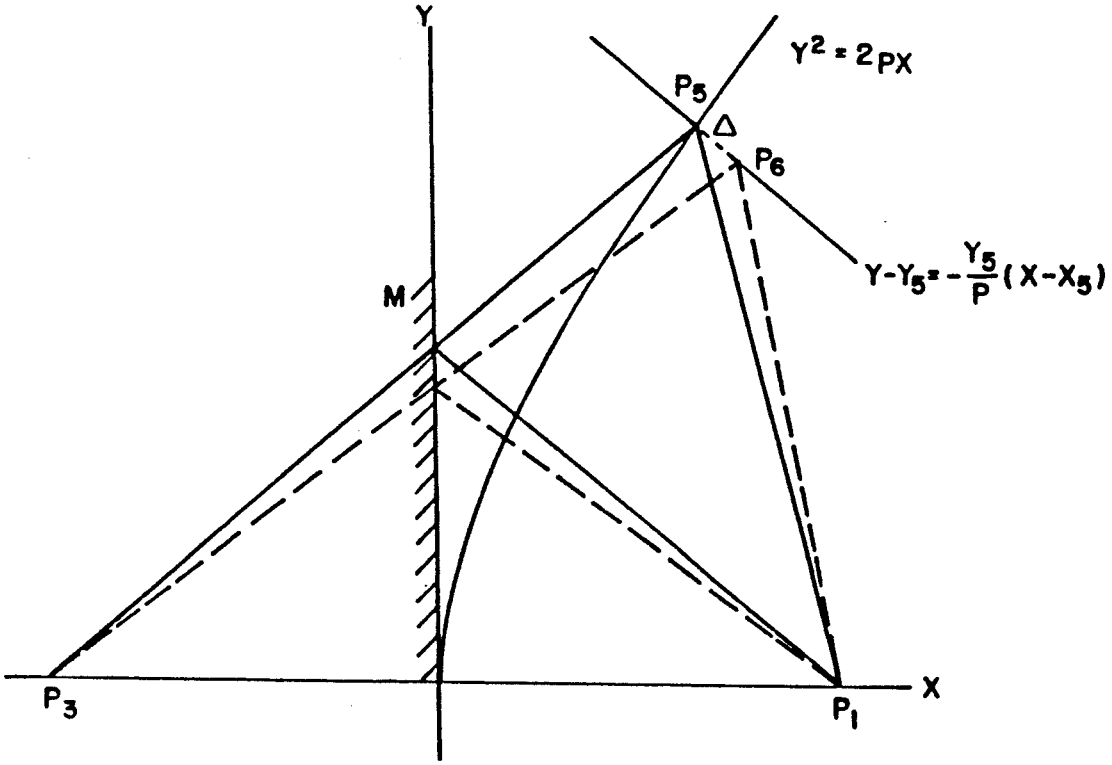
FIG. 5 shows two dimensional mathematical vectors for two stationary laser sources and a deforming parabola.

Assume in FIG. 5 that the antenna's two dimensional parabolic contour $y=2p\cdot x$ is deformed in normal direction at point $P_5$ $(x_5,y_5)$. The coordinates $x_6$, $y_6$ of the new point $P_6$ at distance $\Delta$ can be derived from the equation of the normal at $P_5$, $y=y_5-(y_5/p)\cdot(x-x_5)$. The number of fringes n that a sensor at $P_5$ penetrates as it moves to $P_6$ is $n=(\overline{P_5P_3}-\overline{P_5P_1}-(\overline{P_6P_3}-\overline{P_6P_1}))/\lambda$, with $\lambda$ the laser wavelength. Conversely, a fringe counting sensor is capable of detecting a normal displacement of at least $\Delta/n$. The resolution is inversely proportional to $\lambda$.

For example, consider a reflector P with a parabolic equation $y^2=10.61x$ and an outer edge point $x_5=1.84$ m and $Y_5=4.42$ m. For $\Delta=1.10^{-4}$ m, $\lambda=6.28\times10^{-7}$ m (HeNe laser), and $x_1=1.84$ m, we obtain after some trigonometric manipulation a fringe count of 102. That is, a normal deformation of the paraboloid of one tenth of a millimeter at the outer edge produces a fringe count of 102. For $x_5=0.1$ m, that is near the center of the paraboloid, the number is $n=274$. Positioning the laser source closer to the paraboloid's apex, such as at $x_1=0.1$ m, leads to counts of $n=6$ and $n=30$, respectively. The parameters chosen in an actual system may be quite different from the ones above, depending on such considerations as resolution required, laser characteristics, and sensor spatial resolution.

Figure 6:
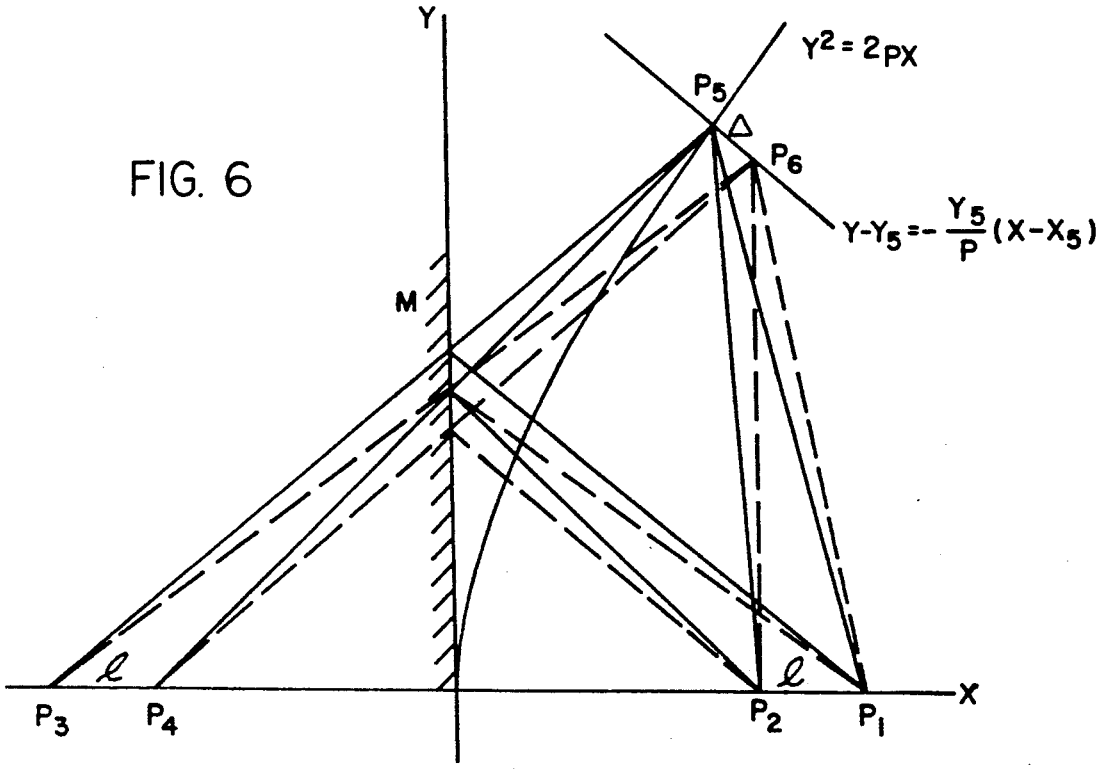
FIG. 6 shows two dimensional mathematical vectors for two moving laser sources and a deformed parabola.

Whereas the system described mathematically in FIG. 5 is capable only of monitoring deformations from a reference contour, we have modified this system in FIG. 6 in such a way, that it is now capable of returning point $P_6$ to $P_5$, where $P_5$ is a point on the true parabola. Assume, as before, a laser source at $P_1$ and its virtual image at $P_3$. If we move the laser a known distance 1 along the x-axis from $P_1$ to $P_2$, and the image from $P_3$ to $P_4$, then the hyperbolic fringe pattern changes, leading to a fringe count at the stationary sensor at point $P_6$. This fringe count is unique to this location, just as there is a unique count to location $P_5$, which represents a point on the true parabola. A reflector alignment system, which is being energized from any arbitrary deformed shape adjusts itself to true paraboloidal shape by knowledge of previously stored fringe counts at all control points. Mathematically the differential fringe count is $n_5-n_6=(\overline{P_5P_3}-\overline{P_5P_1}-(\overline{P_5P_4}-\overline{P_5P_2}))/\lambda-(\overline{P_6P_3}-\overline{P_6P_1}-(\overline{P_6P_4}-\overline{P_6P_2}))/\lambda$. A differential fringe count higher or lower than the expected one at a given sensor location can be used to unambiguously move the actuator to its optimum length.

Figure 7:
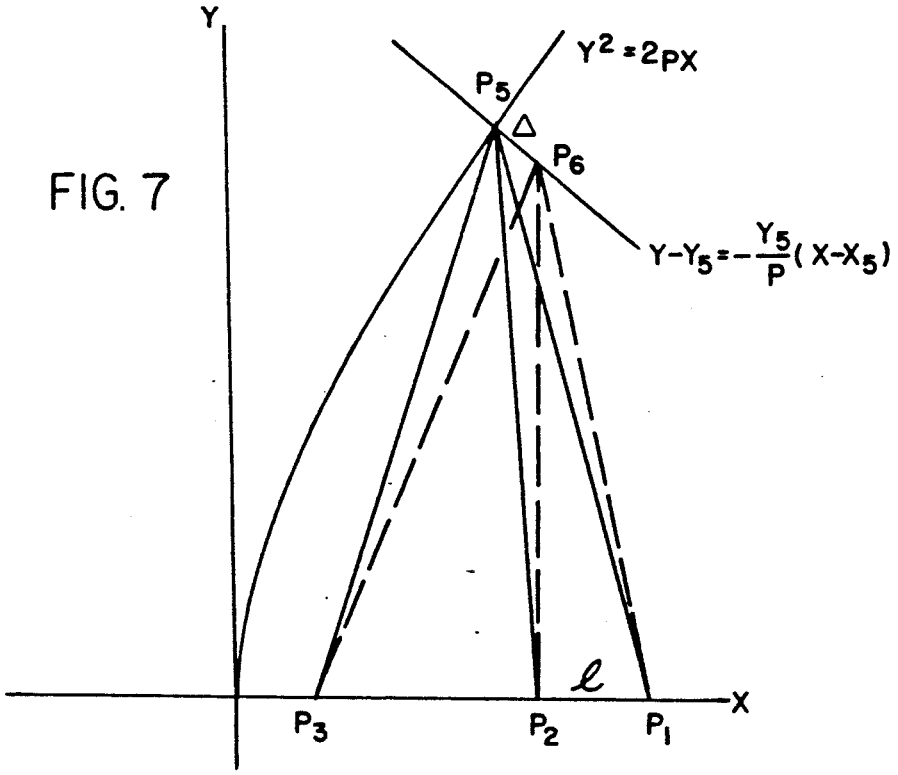
FIG. 7 shows two dimensional mathematical vectors for a fixed laser source, a moving laser source, and a deformed parabola.

As has previously been mentioned, one problem with the virtual source concept is the need for a plane reflecting mirror at the origin. Depending on the paraboloidal parameters, this may require omission of a fairly large central portion of the reflector to avoid blockage of the laser radiation. A more optimal configuration of the laser sources than in FIG. 6 is shown in FIG. 7. It is obvious, that the image source in FIG. 6 must not necessarily move in order to establish a system of moving hyperbolas. It can be held stationary at $P_3$. In this case, however, it provides only a constant reference phase at locations $P_5$ and $P_6$ to obtain differential fringe counts. Thus, in FIG. 7, the image source is conveniently placed along the x-axis, inside of the intact parabola. As before, the laser source moves from P1 to $P_2$ to obtain fringe counts at $P_5$ and $P_6$. With the new geometry we find $n_5-n_6=(\overline{P_5P_2}-\overline{P_5P_1})/\lambda-(\overline{P_6P_2}-\overline{P_6P_1})/\lambda$. This differential fringe count is independent of the location of $P_3$.

To illustrate this case we again make use of the example given with FIG. 5. Additionally, we assume that the laser moves a distance $1=0.05$ m from $P_1$ towards the apex of the parabola. With $P_1$ at $x_1=0.1$ m, we find after some trigonometric manipulation, $n_5=29537$ at $x_5=1.84$ m and a change $n_5-n_6=1.5$ as $P_5$ moves to $P_6$. Similarly, at $x_5=0.1$ m we have $n_5=1931$ and $n_5-n_6=7.6$. A laser reference system with 50 mm linear displacement, mounted 100 mm from the reflector apex is thus able to recognize a deformation of 0.1 mm both at the reflector's edge and near the apex. One assumes that a laser system of such a short baseline can be stably mounted to the apex area of the reflector. Note the fact that in this second embodiment of the laser alignment system, the fringe count is made while the reflector contour is stationary. Expressed differently, the laser displacement must occur at a rate fast compared with the reflector's rate of deformation.

Figure 8:
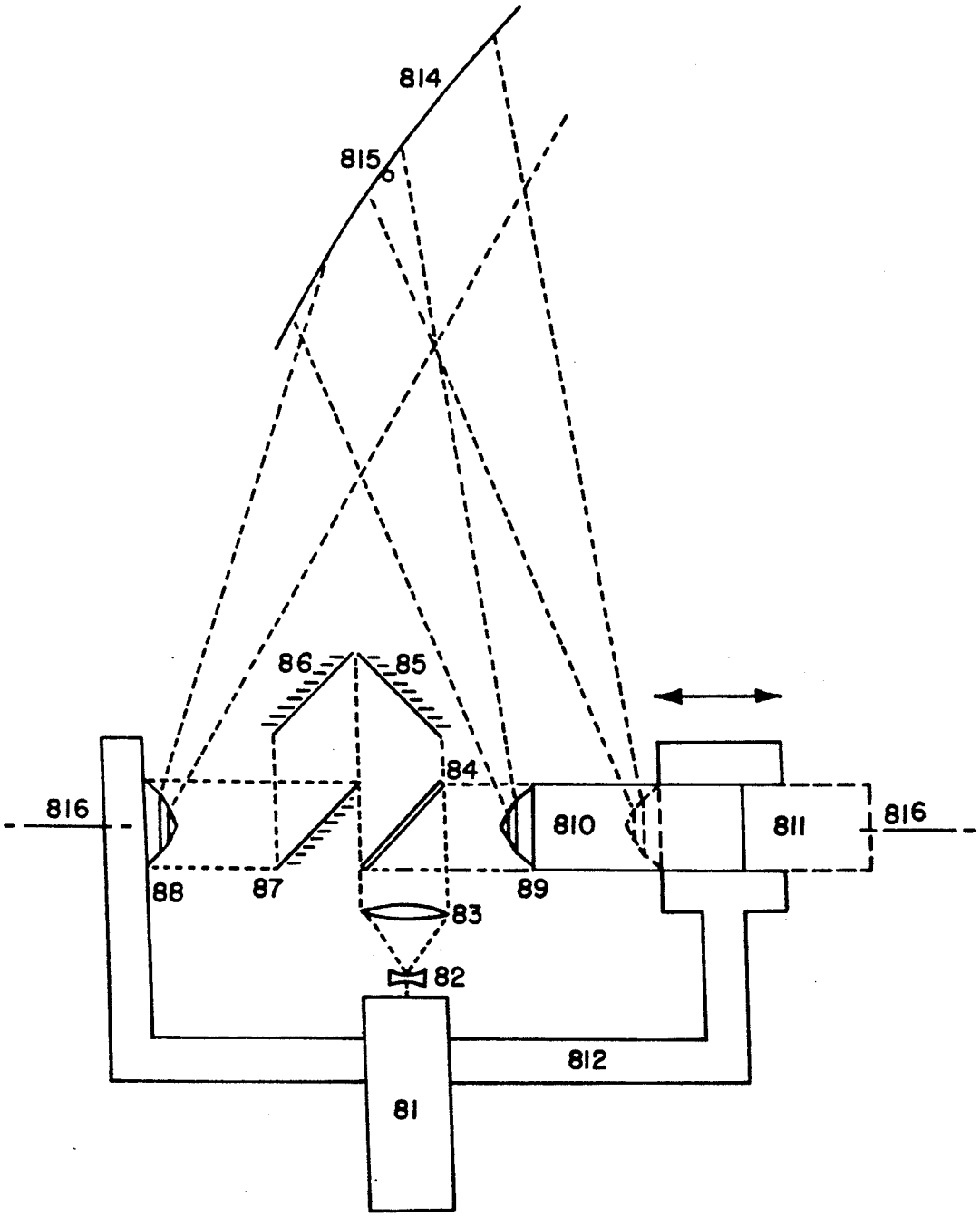
FIG. 8 is a schematic illustration of a practical system based on FIG. 7.

A practical implementation of the laser reference system in FIG. 7 can be seen in the next figure. Radiation from the laser 81 in FIG. 8 is collimated by lenses 82 and 83 into a beam of larger diameter and of uniform density. Beamsplitter 84 transmits part of this beam towards a set of truncated reflecting cones 89 and part to a similar structure 88 after 90 degree reflections from plane mirrors 85, 86, and 87. The sets of truncated reflecting cones 88 and 89 are coaxial with each other and with the paraboloidal reflector axis 816. Cone set 88 is rigidly attached to the antenna frame support structure 812, which also holds a piston 810, which moves along axis 816 between piston positions 810 and 811. Cone set 89 is rigidly attached to moving piston 810. Laser radiation impinging on cone sets 88 and 89 is reflected towards sensor 815, shown here attached to a portion of the paraboloidal reflector 814. Cone sets 88 and 89 are shown to illuminate sensor 815 over the whole range of motion of piston 810. The use of truncated cones leads to uniform illumination on the reflector in circumferential direction. This is not necessary and may actually be detrimental for reasons of limited power impinging on sensors, which occupy only a small part of the total reflector surface. It may therefore be beneficial to shape reflectors 88 and 89 differently for spot illumination of sensors with the consideration in mind, that a particular sensor must be illuminated over the whole distance of travel of cone set 810. Thus, the reflectors 88 and 89 can be multifaceted, individually focussing, and matched to the specific paraboloidal contour and sensor pattern. The laser reference system in FIG. 8 is shown by way of illustration only. Many other implementations are conceivable to reach the same objective.

Thus, the reference system as described is based on counting integral numbers of fringes at an optical wavelength. Wavelengths longer than optical may be practical as well, assuming that they are different from the wavelength or wavelength region within which the antenna is actually being used for radio signal emission or collection, and that these radio signals can be separated from the ones used for antenna alignment by electrical filtering so that the two operations do not interfere with each other.

At a longer wavelength it may become necessary to measure the sensor location more precisely than available from integral fringe counting. In this case a more precise sensor location may be derived from the known amplitude variation between fringe maxima and minima, or by making an accurate phase measurement between the fixed and moving reference signals originating at locations 88 and 89 in FIG. 8. Both methods amount to the counting of fractioal fringes.

Whereas one pattern of segmentation of a paraboloidal reflector was given in FIG. 2, many other patterns can be thought of to create individually controllable segments. A basic one in FIG. 9 makes use of a honeycomb shaped structure. The individual hexagonal segments are of identical projected circumferential shape, though not of identical contour. Shown is a plan projection of the paraboloid with a non-circular edge due to segment shape. The center segment, attached to the laser reference system, is considered rigid. That is, at locations 96 adjacent panels are connected by ball-joint type linkages only. Locations 95 carry sensors and actuators. Panel 91 constitutes a first ring, panels 92 a second ring, panels 93 and 94 a third ring, and so forth as the structure continues outwards. Panels with identical numbers are identical in shape. Table 1 lists the parameters of this design in ascending numbers of rings.

TABLE 1

| Rings | Panels | Shapes | Ball-Joints | Sensors/ Actuators |
|---|---|---|---|---|
| 1 | 1 | 1 | 0 | 0 |
| 2 | 7 | 2 | 3 | 9 |
| 3 | 19 | 4 | 3 | 24 |
| 4 | 37 | 7 | 3 | 49 |
| 5 | 61 | 10 | 3 | 76 |

An advantage of this design is the approximately equal size of the three-point adjusted segments.

Figure 10:
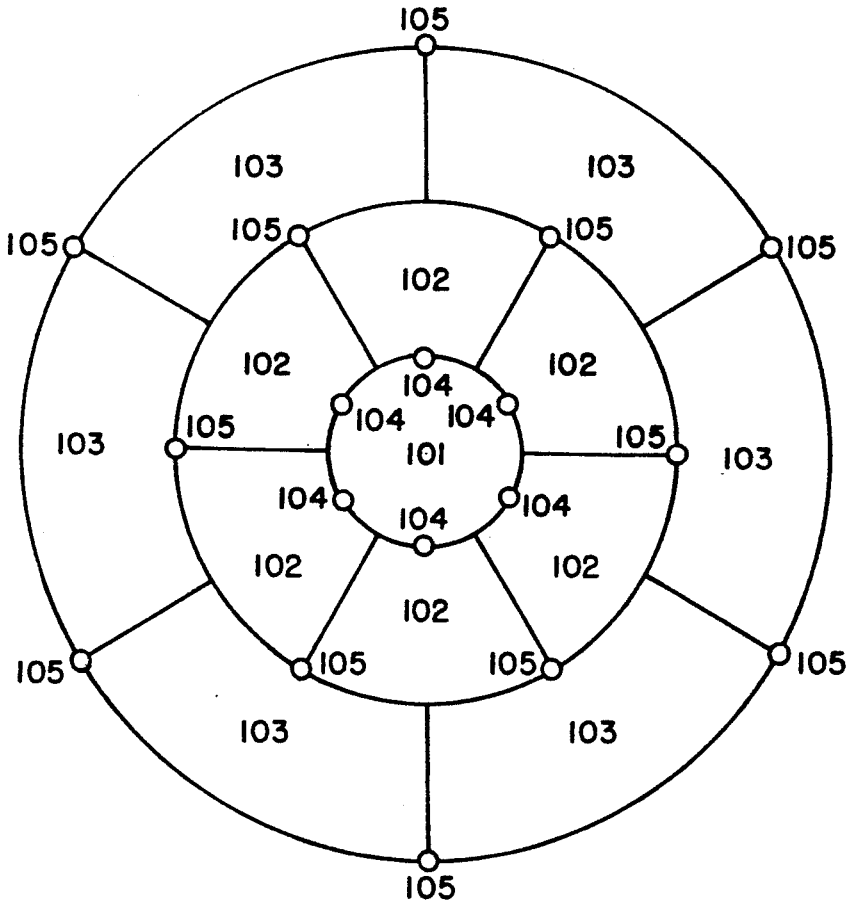
FIG. 10 is a third kind of segmentation of the adjustable reflector surface.

The plan projection of another form of segmentation of a paraboloidal reflector is given in FIG. 10. Here individual panels take the shape of four-cornered ring segments. Each segment is again adjusted at three locations. The benefit of this kind of subdivision lies in a lower number of different panels. The increase in panel size with increasing ring size is not necessarily to advantage. Parameters of this design can be found in Table 2.

TABLE 2

| Rings | Panels | Shapes | Ball-Joints | Sensors/ Actuators |
|---|---|---|---|---|
| 1 | 1 | 1 | 0 | 0 |
| 2 | 7 | 2 | 6 | 6 |
| 3 | 13 | 3 | 6 | 12 |
| 4 | 21 | 4 | 6 | 18 |

We refer back now to FIG. 2, where the sensor/actuator locations are identical with FIG. 10 but segments are cut differently. The individual adjustable panel is of triangular shape here, with control points or ball-joints at each corner. The total reflector surface is broken up into smaller individual surfaces, placing less stringent requirements on their internal rigidity without increasing the number of control points. The number or panel shapes is higher in FIG. 2. Table 3 lists all parameters.

TABLE 3

| Rings | Panels | Shapes | Ball-Joints | Sensors/ Actuators |
|---|---|---|---|---|
| 1 | 1 | 1 | 0 | 0 |
| 2 | 13 | 3 | 6 | 6 |
| 3 | 25 | 5 | 6 | 12 |
| 4 | 37 | 7 | 6 | 18 |

Figure 9:
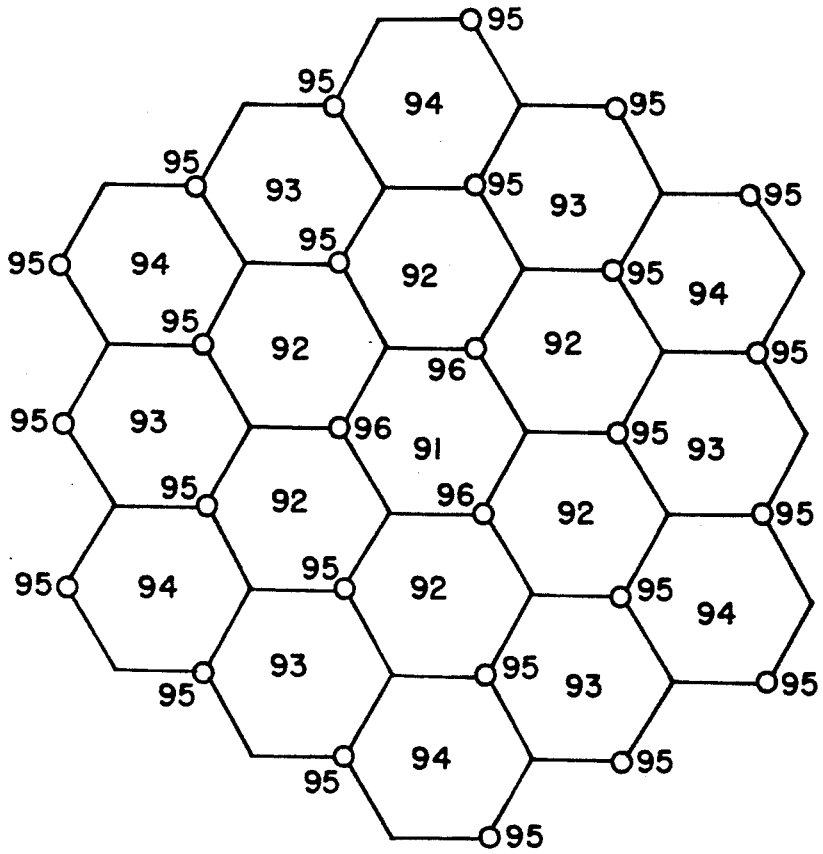
FIG. 9 is a second kind of segmentation of the adjustable reflector surface.

It should be obvious at this point, that the segmentations in FIGS. 2, 9, and 10 are examples of reflector subdivision only. Ring numbers and numbers of ball-joints by themselves, when increased or decreased, provide for another multitude of subdivisions. Also, the reflector contour need not be paraboloidal but can be of any other mathematical or empirical shape. It need not be a reflector at all. It can be any three dimensional structure or surface that one would like to control by such an alignment system.

Figure 11:
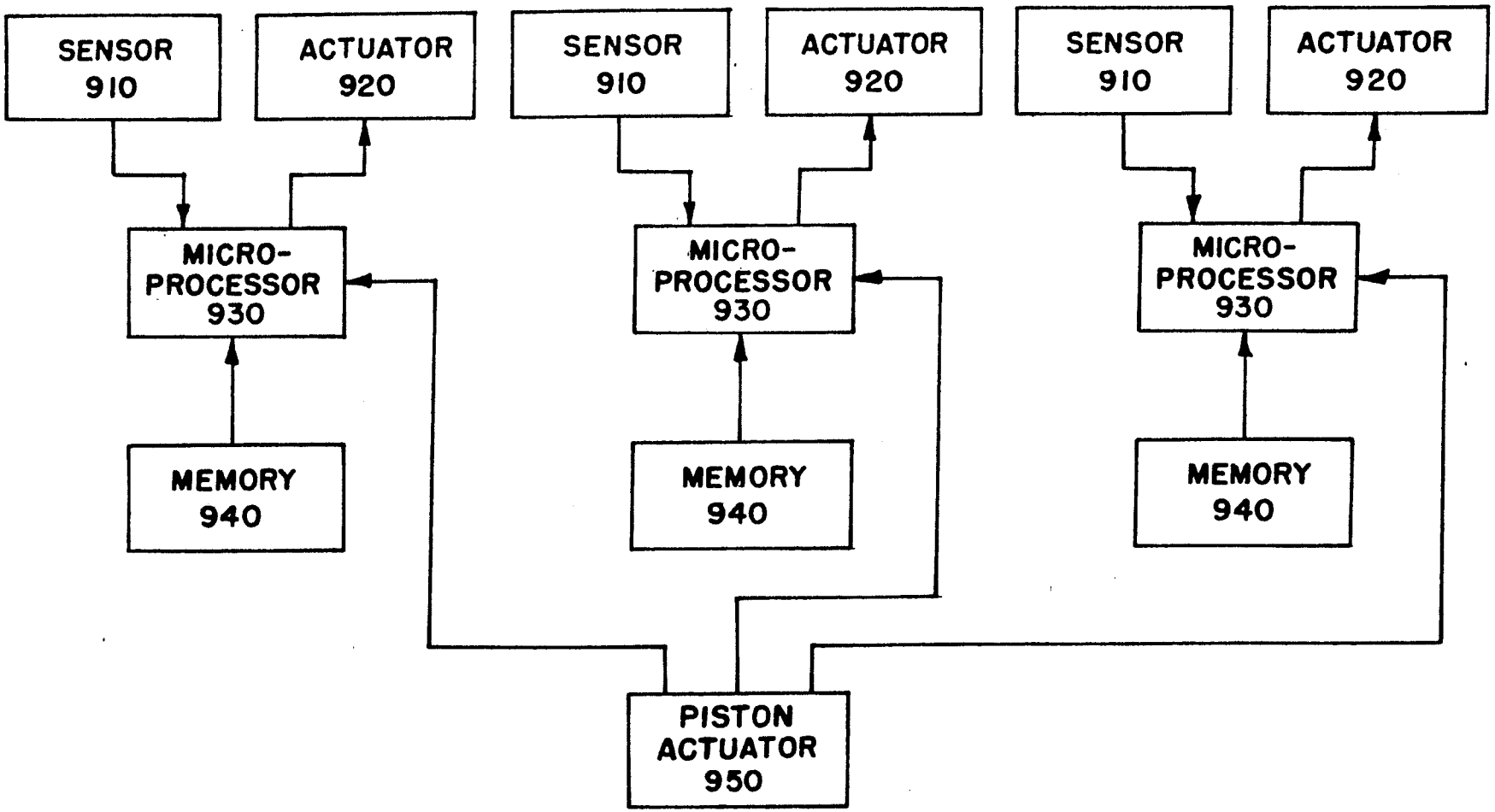
FIG. 11 is a block diagram of the elements of the laser reference control system.

FIG. 11 is a block diagram of the laser reference control system which serves to monitor and adjust the surface contour produced by the triangularly suspended segments of the present invention. This laser reference control system, as configured to operate in accordance with FIGS. 2, 7, and 8, includes: an electrical actuator 950 for piston 810, a plurality of position sensors 910, a plurality of piezoelectric and/or electromechanical actuators 920, a plurality of dedicated microprocesors 930, and a plurality of memories 940, one memory serving one microprocessor 930 each.

As discussed above, the sensors 910 make a digital count of fringes, that is, they deliver a pulse train of electrical signals to microprocessors 930, where the exact number of pulses depends on the location of a particular sensor on the paraboloidal surface, respectively, on the deviation in position of this sensor from its ideal location on the paraboloid. On condition of a relatively slow deformation of the paraboloidal surface as postulated earlier, fringes are being sensed by sensors 910 only due to the motion of piston 810 in FIG. 8. The piston actuator 950 in FIG. 11 is an electromechanical device moving the piston 810 with constant or sinuoidaly changing velocity along the paraboloid axis. The whole unidirectional range of piston motion or a fraction thereof is signalled to each of the microprocessors 930 as the beginning and the end of a counting interval. A reference count, depending on the ideal location of a particular sensor 910 is stored in the memory 940 which is coordinated with this sensor. The reference count is computed once for each sensor location and is permanently stored in the memory. It is different for all sensors not on concentric and orthogonal circles relative to the paraboloid axis. The reference count depends on various system parameters as described, but is constant for a given system, once the change in actual sensor count is due only to paraboloid deformation. At the end of a counting interval, each microprocessor 930 compares its sensor's count with the reference count and transmits a digital pulse sequence to its associated actuator 920 to correct for the observed displacement of the paraboloid at this location. A digitally stepping motor converts these pulses into a shaft rotation such as needed with a lead screw type actuator, or a digital-/analog converter generates an analog drive signal from the pulse train for a piezoelectric transducer.

As long as the surface contour retains its perfect paraboloidal shape, each sensor will always detect a number of fringes which corresponds with its ideal reference number of fringes. When a defect takes place in the surface contour, a group of sensors 910 may be physically moved in space by a local deformation. The displacement will cause these sensors to measure a number of fringes which differs from the ideal number. A correction in location by the actuators 920 associated with these sensors will then take place.

A laser reference control system has been described which relies on parallel processing with a multiplicity of identical microprocessor systems. This is one possible implementation of such a control system and serves only to demonstrate the principle. A single sequentially processing central computer system is conceivable.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A paraboloidal antenna system which has an axis and a paraboloidal shape formed by an adjustable segmented surface contour which forms a composite surface, said paraboloidal antenna system comprising:

an antenna frame support structure;

a plurality of reflective segments which are fixed to said antenna frame support structure, and which have a paraboloidal surface contour, wherein each of said plurality of reflective segments has three attach points, with each attach point adjacent to the attach point of at least two reflective segments at a location which forms control points at which the attach points of the reflective segments may be moved to adjust the adjustable segmented surface contour of the paraboloidal antenna system;

a plurality of electromechanically expanding and contracting transducers, each of which is fixed between said antenna frame support structure and an attach point of a plurality of reflective segments, each of said plurality of transducers being a controllable piston which allows the attach point of a plurality of reflective segments to be adjustably positioned with respect to said frame;

a plane mirror which is fixed to said antenna frame support structure along the paraboloidal antenna system's axis;

a laser source which is fixed along said paraboloidal antenna system's axis and which emits a coherent laser beam towards said plane mirror to generate a reflected portion of said laser beam upon reflection from said plane mirror and a non-reflected portion of said laser beam, said reflected portion of said laser beam having an interaction with the non-reflected portion of said laser beam to produce thereby a hyperboloidal fringe pattern with circular symmetry across the surface contour of said paraboloidal antenna system, said hyperboloidal fringe pattern varying with the location of said laser source and adjustment of said transducers; and a means for measuring changes in fringes of said hyperboloidal fringe pattern at said control points, said measuring means thereby detecting changes in the surface contour of the paraboloidal antenna system.

2. A paraboloidal antenna system, as defined in claim 1, wherein said measuring means comprises a set of photodetectors, each of which are fixed at said control points along the surface contour of said paraboloidal antenna system to measure thereby said changes of fringes of said hyperboloidal fringe pattern.

3. A paraboloidal antenna system, as defined in claim 2, wherein said plane mirror and said laser source are mounted along the axis of the paraboloidal antenna system so that said hyperboloidal fringe pattern is stationary in space and time, and wherein said measuring means counts fringes to produce fringe counts upon deformation of the paraboloidal shape, said fringe counts being a means to measure the change in the adjustable segmented surface contour, and a means for guiding restoration of the composite surface to its previous shape by moving said actuators by amounts which are commensurate with the fringe counts at locations of the transducers.

4. A paraboloidal antenna system, as defined in claim 3, wherein said plane mirror mounted along the axis of the paraboloidal antenna system is stationary, and said laser source is moving repetitively over a fixed distance along said axis, causing said hyperboloidal fringe pattern to move spatially with time, and wherein said measuring means counts fringes to produce fringe counts, said fringe counts being a measure of deformation from an ideal paraboloidal antenna shape and a means to restore the composite surface to said ideal paraboloidal antenna shape by adjusting said transducers by amounts which are commensurate with the fringe counts at the respective actuator locations.

5. A paraboloidal antenna system as defined in claim 4, wherein the fringe counts for the ideal paraboloidal antenna shape are computed from system parameters and compared with actually measured fringe counts whereupon said transducers are adjusted until said measured fringe counts equal said computed fringe counts, thereby adjusting the deformed surface to an ideal paraboloidal contour.

* * * * *